United States Patent [19]

Sutton

[11] 4,431,230

[45] Feb. 14, 1984

[54] PORTABLE SEAT DEVICE

[76] Inventor: Robert J. Sutton, 6400 63rd Pl., Riverdale, Md. 20737

[21] Appl. No.: 276,888

[22] Filed: Jun. 24, 1981

[51] Int. Cl.[3] ..... A47C 31/00

[52] U.S. Cl. ..... 297/217; 297/192; 248/96

[58] Field of Search ..... 297/217, 192, 188, 445, 297/461, 294, 295; 248/316.9, 360, 96; 150/1.5 R, 1.5 B; 190/42

[56] References Cited

U.S. PATENT DOCUMENTS

| | | | |
|---|---|---|---|
| 1,423,043 | 7/1922 | Steinheiser | 248/360 |
| 1,555,019 | 9/1925 | MacDonald | 248/96 |
| 2,435,479 | 2/1948 | Thommen | 150/1.5 R |
| 2,621,799 | 12/1952 | Wilson | 248/96 |
| 2,716,332 | 8/1955 | Duffy | 248/96 X |
| 2,751,955 | 6/1956 | Nahon | 150/1.5 R |
| 3,363,940 | 1/1968 | Miller | 297/217 |
| 3,799,227 | 3/1974 | Cantwell | 150/1.5 R |
| 4,108,409 | 8/1978 | Rombach et al. | 248/96 |
| 4,210,363 | 7/1980 | Talpalus | 190/42 |
| 4,295,680 | 10/1981 | Grasso | 297/217 |

*Primary Examiner*—Francis K. Zugel

[57] ABSTRACT

A portable seat device, constructed from light weight resilient material, is an open rectangular configuration having one side comprised of two free ends. When upright on one side, the portable seat device serves as a backless seat, and it can be used by itself or in combination with objects enclosed about their periphery. With objects having means for their own transportation, such as attached shoulder straps; the portable seat device can be transported while enclosed about such objects. While enclosed about objects lacking these means of transportation, the combination can be carried by hand, with the fingers inserted in the aperature located in one side of the portable seat device.

2 Claims, 5 Drawing Figures

PORTABLE SEAT DEVICE

REFERENCES CITED

| U.S. Pat. Nos. | | | |
|---|---|---|---|
| 3,363,940 | 1/1940 | MILLER | 150/1.5R |
| 4,210,363 | 7/1980 | TALPALUS | 190/41 |

BACKGROUND OF THE INVENTION

There are times when picnicking, hiking, golfing, etc., one desires a place to rest but facilities may be lacking. This problem can be solved often with chairs and seats available as portable furniture which can be folded when not in use or when being transported. It is an object of this invention to provide a portable seat device to support a user at rest, to minimize space and storage requirements and to provide means for its transportation by enclosing the portable seat device about those objects essential to the activity undertaken.

DESCRIPTION OF THE PRIOR ART

The prior art discovered in my search relates to a seat attachment for golf bags and a portable seat container. James G. Miller's "Seat Attachment for Golf Bag," U.S. Pat. No. 3,363,940, patented in Jan. 16, 1940, appears obsolete with respect to most golf bags now in use. Today most golf bags have round bases rather than rectangular bases, as specified in mr. Miller's invention. This is an essential feature of this prior art. With a round base, this prior art does not appear to function as designed and lacks stability and strength to prevent tilting under the weight of the golfer sitting on the seat attachment. This prior art is greatly dependant upon metal parts having had extensive shaping and tooling such as grooving the seat portion and serrating the ends. Another requirement for this prior art to function is the assembly must be bolted to the base of the golf bag after it has been modified by drilling a hole in the base. The invention "Portable Container Seat" by Larry R. Talpalus, U.S. Pat. No. 4,210,363, patented in July 1, 1980, is an elongated tubular body with a base end and a plastic covered top as a seat. The device is transported by an attached shoulder strap. It's principle object is a portable seat having its storage space capacity limited to within the hollow cylindrical body, and it is used as a seat when placed on its base end.

SUMMARY OF THE INVENTION

My invention relates to a portable seat device constructed from light weight resilient material in the form of a rectangular configuration being open, without a top and a bottom, comprised of four sides and with one side having two free and overlapping or abutting ends. The side opposite these ends has an elongated oval shaped aperature centered about the longitudinal centerline thereof having sufficient width and length for insertion of the fingers of the hand to transport the portable seat device, when not in use. When placed upright on one side, the upper side serves as the seat portion for the user to rest under the support of the remaining sides of the structure.

The primary object of my invention is a portable seat device to be carried when not in use and used as a seat when placed upon a reasonably level surface, however my invention is not necessarily so limited.

An object of my invention is to provide a new and improved portable seat device.

Another object and an advantage of my invention is to provide a seat device that is portable by being carried in the grasp of the user's hand or by being attached to objects.

A further object and advantage of my invention is to provide a portable seat device to be attached to objects having different shapes and sizes.

Still another object and advantage of my invention is to provide a portable seat device easily attached to objects and independant of modifications thereto.

Other objects and advantages, the design of my invention, the form of the portable seat device and the mode of the operation will become apparent from the following dexcription.

DESCRIPTION OF THE PREFERRED EMBODIMENT

Figure 1:
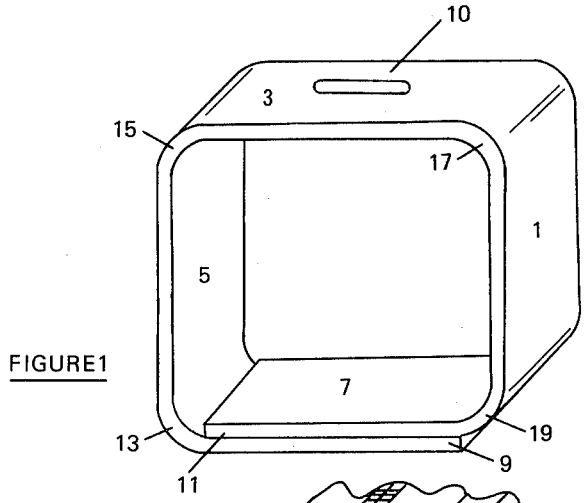
FIG. 1 is a perspective view of my invention by itself, in the upright position. In the drawing.

Referring to the drawings in greater detail, the portable seat device is best shown in FIG. 1 a open rectangular form comprised of four corners 13, 15, 17 and 19; four sides 1, 3, 5 and 7; and free ends 9 and 11 overlapping but can be abutting. With sufficient length and width to said sides; the portable seat device stands upright and can be used by itself as a backless seat, when placed on a reasonably level surface. Any side 1, 3, 5 or 7 can be the seat portion supported by the remaining sides of the structure; though the preferred seat portion is the exterior surface of side 3. The portable seat device can be carried by hand with fingers inserted into the elongated aperature 10 located in side 3.

Figure 2:
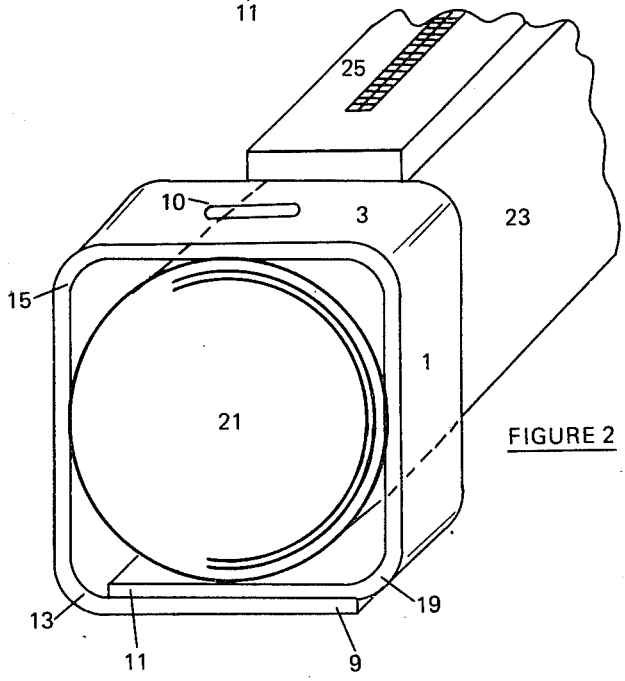
FIG. 2 is a perspective view illustrating my invention attached to a golf bag, shown in fragmentary detail. In the drawing.

Another mode of operation is the portable seat device used in combination with objects having a body member with peripheral dimensions approximating the interior dimensions of the portable seat device and attached means for transportation, such as golf bags and backpacks, with their attached shoulder straps. Used in combination with such objects, the corners 13 and 19 are seperated manually to enlarge the interior circumference of the portable seat device and enclose the body member of the object. When released, the portable seat device restores itself with a close fit about the periphery of the body member. With this freedom of the ends 9 and 11, the interior circumference of the portable seat device can be varied to enclose objects having different shapes and dimensions. In combination with a golf bag 23, the portable seat device is shown enclosed about the bottom end 21 of the golf bag, shown in fragmentary detail, in the perspective view, FIG. 2. The means to attach the portable seat device to a golf bag is a simple operation and independant of any modifications thereto.

Figure 3:
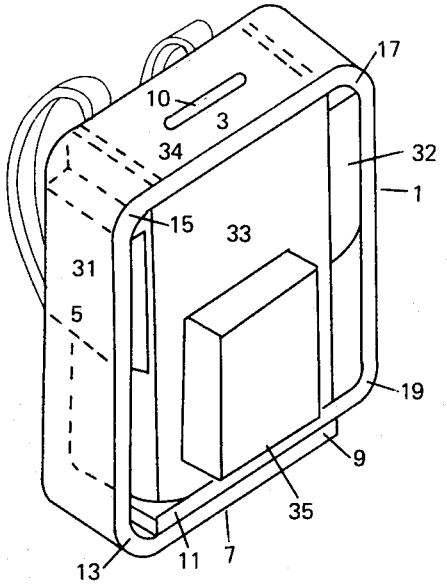
FIG. 3 is a perspective view of the portable seat device enclosed about top, bottom and sides of the backpack, shown in phantom detail.

Simply spread apart the corners 13 and 19 to pass over and encircle the bottom end of the golf bag. With release of the corners, the rectangular configuration is restored to its normal shape, and the portable seat device is retained about the bottom end of the golf bag, without restriction to or interference with its normal use and availability of its contents. The close fit retains the portable seat device about the end of the golf bag, in its functional position; even when the bag is vertical to handle its contents, horizontal to transport the bag or on the ground to support the user at rest. In combination with backpacks, the portable seat device, having greater dimensions, can enclose the sides 31 and 32, top 34 and bottom 35 of the backpack and retain its position when the pack is on the hiker's back, as shown in phantom detail, in the perspective view in FIG. 3. Removing the pack from the hiker's back, the combination can be placed on the ground providing the hiker a place of rest.

Figure 4:
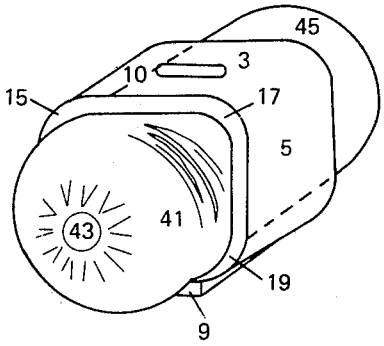
FIGS. 4 and 5 are perspective views of the portable seat device enclosed, respectively, about the circumference of the stuff bag and about the top and bottom of the stuff bag and its cylinderical body longitudinally.
Figure 5:
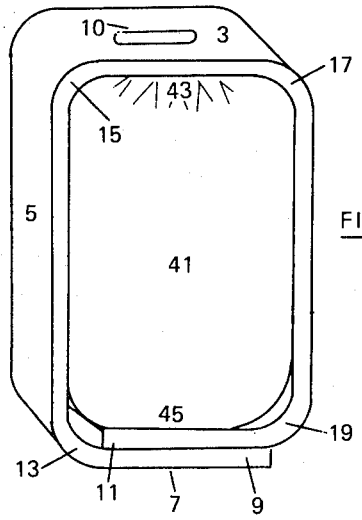

Still another mode of operation is the portable seat device in combination with objects having a body member with peripheral dimensions approximating the interior dimensions of the portable seat device, but lacking attached means for their transportation; such as camping gear like tents, sleeping bags, etc. packed in their stuff bags. In combination with stuff bags, the portable seat device can be enclosed about the cylinderical body longitudinally, the top 43 and the bottom 45, as shown in the perspective view in FIG. 5. In combination with stuff bags, the portable seat device, having lesser dimensions, can also be enclosed about the circumference of the stuff bag, as shown in the perspective view FIG. 4. In combination with these objects and the portable seat device upright on the ground, the user can rest in a seated position. This combination can be transported by hand with the fingers inserted into the aperature 10.

The preferred material of my invention is acrylic plastic, though any light weight material can be used having sufficient strength to support the user and having flexibility and rigidity to vary the interior circumference of the portable seat device for enclosure about an object.

Although the preferred embodiment has been described it will be understood that within the purview of my invention various changes may be made in form, details, and mode of operation; which generally stated consists of a device capable of carrying out objectives set forth as disclosed and defined in the following claims.

I claim:

1. A portable seat device comprising a wide band of resilient material having 4 sides 4 corners and overlapping ends, in combination with a bag having attached means of transportation such as a golf bag, said sides having sufficient length and width to encompass said bag when the corners adjacent to said ends are separated to enlarge the interior circumference of said device, said device returning to normal shape and closely fitting about the periphery of said bag when said corners are released, said close fit providing means of transporting said device when said bag is being transported and said band being wide enough to provide means for supporting a user seated on said device when said combination is placed on a reasonably level surface.

2. A portable seat device comprising a wide band of resilient material having 4 sides 4 corners and 2 overlapping ends, in combination with a bag lacking attached means of transportation such as a stuff bag, said sides having sufficient length and width to encompass said bag when the corners adjacent to said ends are separated to enlarge the interior circumference of said device, said device returning to normal shape and closely fitting about the periphery of said bag when said corners are released, said close fit providing means of transporting said combination by the hand with fingers inserted into a sufficiently elongated aperature, said aperature being centered about the center-line of the side opposite the ends, said band in said combination being sufficiently wide to support a user seated on said device when placed on a reasonably level surface such as the ground.

* * * * *